US012357867B2

(12) United States Patent
Xu

(10) Patent No.: US 12,357,867 B2
(45) Date of Patent: Jul. 15, 2025

(54) CHEST EXPANDER

(71) Applicant: Jian Xu, Zhejiang (CN)

(72) Inventor: Jian Xu, Zhejiang (CN)

( * ) Notice: Subject to any disclaimer, the term of this patent is extended or adjusted under 35 U.S.C. 154(b) by 106 days.

(21) Appl. No.: 18/385,394

(22) Filed: Oct. 31, 2023

(65) Prior Publication Data

US 2024/0342542 A1 Oct. 17, 2024

(30) Foreign Application Priority Data

Apr. 14, 2023 (CN) ..... 202320882660.1

(51) Int. Cl.

| | |
|---|---|
| ***A63B 21/00*** | (2006.01) |
| ***A63B 21/015*** | (2006.01) |
| ***A63B 21/04*** | (2006.01) |
| ***A63B 23/02*** | (2006.01) |

(52) U.S. Cl.

CPC ..... *A63B 21/153* (2013.01); *A63B 21/015* (2013.01); *A63B 21/0435* (2013.01); *A63B 23/0244* (2013.01); *A63B 2220/17* (2013.01); *A63B 2220/833* (2013.01); *A63B 2220/89* (2013.01)

(58) Field of Classification Search

CPC . A63B 21/153; A63B 21/015; A63B 21/0435; A63B 23/0244; A63B 2220/17; A63B 2220/833; A63B 2220/89; A63B 21/00069; A63B 21/023; A63B 2209/08

See application file for complete search history.

(56) References Cited

U.S. PATENT DOCUMENTS 4,114,874 A * 9/1978 Mattila ..... A63B 21/00069 254/374
4,135,714 A * 1/1979 Hughes ..... A63B 21/04 473/229
4,328,965 A * 5/1982 Hatfield ..... F41B 5/1476 482/122
4,779,866 A * 10/1988 Marshall ..... A63B 21/00069 482/116
4,961,573 A * 10/1990 Wehrell ..... A63B 21/0552 482/124
5,147,265 A * 9/1992 Pauls ..... A63B 23/12 482/115
5,226,867 A * 7/1993 Beal ..... A63B 21/025 482/127
5,382,212 A * 1/1995 Davenport ..... A63B 21/04 482/121

(Continued)

*Primary Examiner* — Garrett K Atkinson

(57) ABSTRACT

A chest expander comprises a shell, a rotating shaft, a winding storage wheel, an elastic member, and a pull strap, further comprises a resistance adjustment mechanism, and the resistance adjustment mechanism comprises a resistance wheel, an arc-shaped base strap, and a friction plate, wherein the resistance wheel is arranged on the rotating shaft, the arc-shaped base strap is arranged opposite to a peripheral surface of the resistance wheel, and the friction plate is arranged on an inner surface of the arc-shaped base strap and is in frictional contact with the peripheral surface of the resistance wheel; and one end of the arc-shaped base strap is fixedly connected to the shell, and the other end is movable and adjustable to adjust friction between the friction plate and the resistance wheel. the utility model employs purely mechanical adjustment, which achieves a simpler structure and can greatly reduce costs.

12 Claims, 5 Drawing Sheets

(56) References Cited

U.S. PATENT DOCUMENTS 5,486,149 A * 1/1996 Smith ..... A63B 21/4043 482/904
5,586,962 A * 12/1996 Hallmark ..... A63B 21/4007 482/129
5,618,249 A * 4/1997 Marshall ..... A63B 21/4001 482/92
5,733,231 A * 3/1998 Corn ..... A63B 21/153 482/127
6,436,006 B1 * 8/2002 Zemlyakov ..... A63B 21/155 482/112
6,440,044 B1 * 8/2002 Francis ..... A63B 21/155 482/137
6,929,589 B1 * 8/2005 Bruggemann ..... A63B 21/025 482/904
7,087,001 B1 * 8/2006 Ihli ..... A63B 21/015 D30/153
7,137,936 B1 * 11/2006 Shaw ..... A63B 21/153 482/79
7,871,359 B2 * 1/2011 Humble ..... A63B 21/025 482/121
7,878,955 B1 * 2/2011 Ehrlich ..... A63B 21/025 482/127
9,320,936 B1 * 4/2016 Rea ..... A63B 23/1209
2002/0025891 A1 * 2/2002 Colosky, Jr. ..... A63B 23/00 482/127
2003/0203796 A1 * 10/2003 Yu ..... A63B 21/0628 482/99
2005/0181915 A1 * 8/2005 Hoecht ..... A63B 21/023 482/121
2010/0130338 A1 * 5/2010 Wehrell ..... A63B 21/4007 473/215
2015/0258361 A1 * 9/2015 Xie ..... A63B 21/00196 482/98
2021/0244995 A1 * 8/2021 Andrei ..... A63B 21/0051
2023/0053751 A1 * 2/2023 Lin ..... A63B 21/0056

* cited by examiner

CHEST EXPANDER

TECHNICAL FIELD

The utility model relates to a chest expander.

BACKGROUND OF THE INVENTION

Chinese patent document CN113616977A discloses a resistance mechanism and a chest expander, which relates to the technical field of fitness equipment and solves the technical problem that the resistance of the chest expander cannot be adjusted. The resistance mechanism comprises a clutch component, a speed reducer, and a hysteresis brake. An output shaft of the hysteresis brake is in transmission connection with an input shaft of the speed reducer, and an output torque of the speed reducer can be adjusted by changing current input into the hysteresis brake. The clutch component is located between the speed reducer and a winding wheel. When a pull rope is pulled out and drives the winding wheel to rotate forwards, the clutch component enables the speed reducer and the winding wheel to be in transmission connection. When the pull rope is retracted and drives the winding wheel to rotate reversely, the clutch component enables the speed reducer and the winding wheel to be separated. The output torque of the hysteresis brake can be adjusted by changing the magnitude of the current input to the hysteresis brake, that is, the resistance mechanism can form different magnitudes of resistance for preventing rotation around the winding wheel; and the resistance can achieve stepless adjustment, so use is more convenient. However, the foregoing resistance adjustment mechanism is complex in structure and high in cost, and can be used only with a battery.

OBJECT OF THE INVENTION

The object of the utility model is to provide a resistance adjustable chest expander with simple structure and low cost in response to the shortcomings of the prior art.

BRIEF SUMMARY OF THE INVENTION

The object of the utility model is achieved through the following technical solution:

A chest expander comprises a shell, a rotating shaft, a winding storage wheel, an elastic member, and a pull strap, wherein the winding storage wheel is rotatably arranged in the shell, the pull strap is connected to the winding storage wheel, the elastic member drives the winding storage wheel to rotate to wind and store the pull strap, the rotating shaft is rotatably arranged in the shell and connected to the winding storage wheel by one-way transmission, and the pull strap can drive the rotating shaft to rotate when pulled out from the winding storage wheel, wherein the chest expander further comprises a resistance adjustment mechanism, and the resistance adjustment mechanism comprises a resistance wheel, an arc-shaped base strap, and a friction plate, wherein the resistance wheel is arranged on the rotating shaft, the arc-shaped base strap is made of an elastic deformable material, the arc-shaped base strap is arranged opposite to a peripheral surface of the resistance wheel, and the friction plate is arranged on an inner surface of the arc-shaped base strap and is in frictional contact with the peripheral surface of the resistance wheel; and one end of the arc-shaped base strap is fixedly connected to the shell, and the other end is movable and adjustable to adjust friction between the friction plate and the resistance wheel. Compared with electromagnetic resistance adjustment in the prior art, the utility model employs purely mechanical adjustment, which achieves a simpler structure, can greatly reduce costs, and does not require charging.

The resistance adjustment mechanism further comprises a screw and a nut, the screw is arranged at the other end of the arc-shaped base strap, and the nut is rotatably arranged on the shell and matches the screw. The matching between the screw and the nut can drive the other end of the arc-shaped base strap to move. In this case, the movement of the other end of the arc-shaped base strap can be adjusted by rotating the nut, so as to adjust the resistance of the chest expander.

The shell is provided with a positioning groove for limiting axial movement of the nut, and the positioning groove is opened on a surface of the shell to expose the nut partially outside the shell for operation. This structure can facilitate the operation on the nut and limit the axial movement of the nut.

The winding storage wheel is arranged on the rotating shaft through a one-way bearing. In this case, the pull strap drives the winding storage wheel to rotate forward when pulled out, and the forward rotation of the winding storage wheel can drive the rotating shaft to rotate. When the winding storage wheel rotates reversely under the action of the elastic member to wind and store the pull strap, the rotating shaft is not driven to rotate.

The arc-shaped base strap is a steel strap. The steel strap has better elastic deformation and resetting performance.

The shell is provided with an arc-shaped side plate attached to an outer surface of the arc-shaped base strap. The arc-shaped side plate enables certain pre-tightening force between the friction plate on the inner side of the arc-shaped base strap and the resistance wheel.

The elastic member is a spring, one end of the spring is connected to the winding storage wheel, and the other end is connected to the shell.

A counter is arranged on the shell, the counter comprises a magnetic sensor, and a magnet that can be sensed by the magnetic sensor is arranged on the resistance wheel. When the pull strap is pulled out and drives the resistance wheel to rotate, the magnetic sensor can detect the magnet, and the counter can generate data such as exercise times according to detection signals of the magnetic sensor.

The chest expander further comprises a clearance hole that runs through the arc-shaped base strap and the friction plate. The clearance hole is opposite to the magnetic sensor and the magnet, so that the detection of the magnetic sensor is more accurate.

The shell comprises a top plate, a bottom plate, and an annular side plate connected between the top plate and the bottom plate; and a metal partition spaced apart from the top plate in parallel is arranged in the shell, the resistance wheel and the arc-shaped base strap are located between the top plate and the metal partition, the distance between the top plate and the metal partition is slightly greater than the width of the arc-shaped base strap, and the metal partition can limit the arc-shaped base strap and prevent the arc-shaped base strap from skewing.

An outlet through which the pull strap passes is formed on the shell, two guide rollers opposite and rotatable to the outlet are arranged on the metal partition, the two guide rollers are arranged in parallel, and the pull strap passes between the two guide rollers. The two guide rollers can guide a pull direction of the pull strap, so that the pull strap is pulled out more smoothly.

The metal partition is formed with a connecting plate attached to the annular side plate, a screw hole is formed on the connecting plate, and the annular side plate is provided with a through hole opposite to the screw hole. In this case, a fixing component such as a suction cup can be connected to the screw hole by a bolt, so that the chest expander is fixed to the fixing component such as a suction cup. The connecting plate is arranged on the metal partition to increase the connection strength.

BRIEF DESCRIPTION OF THE DRAWINGS

The utility model will be further described in detail below with reference to the accompanying drawings.

DETAILED DESCRIPTION OF THE INVENTION

Figure 1:
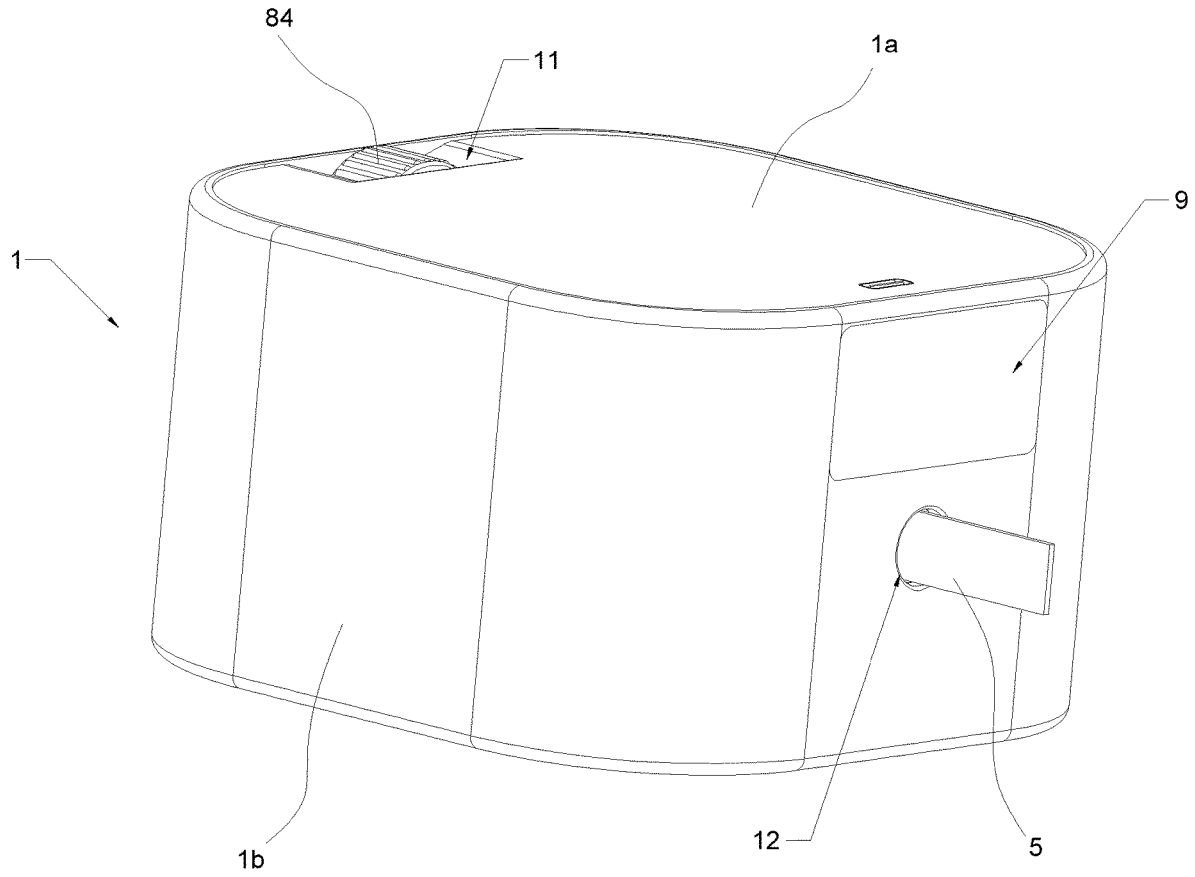
FIG. 1 is a three-dimensional view of the utility model.
Figure 2:
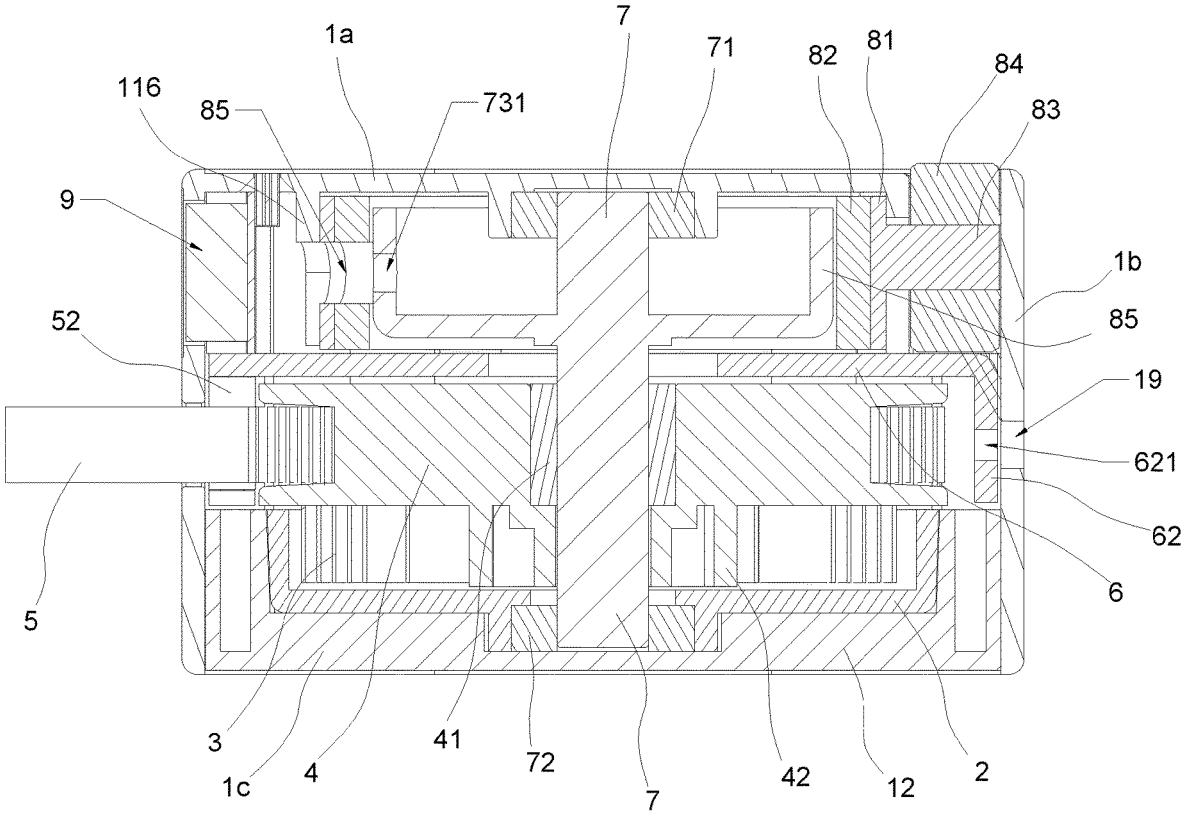
FIG. 2 is a cross-sectional view of the utility model.
Figure 3:
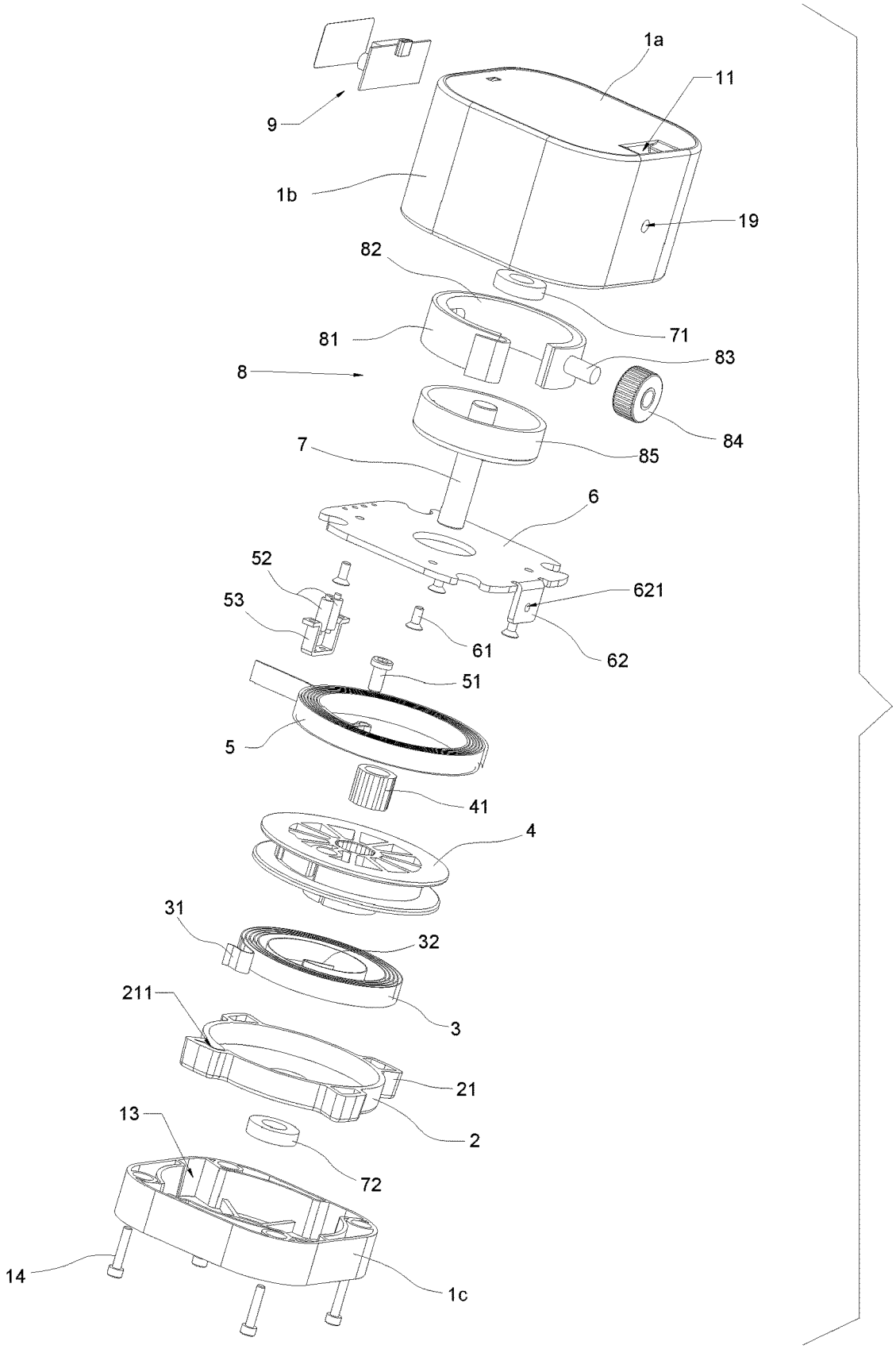
FIG. 3 is an exploded view of components of the utility model.
Figure 4:
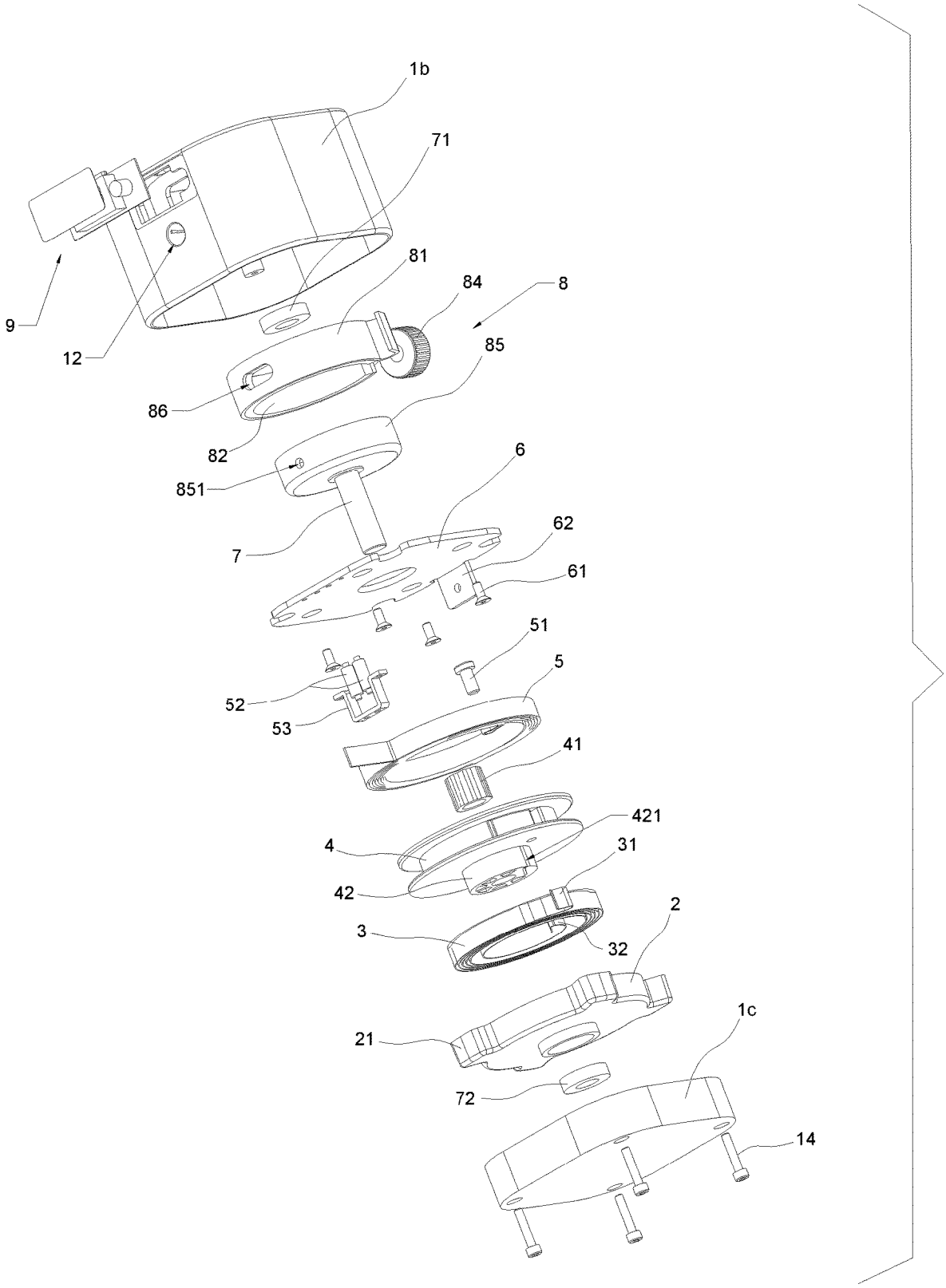
FIG. 4 is an exploded view of components of the utility model from another perspective.
Figure 5:
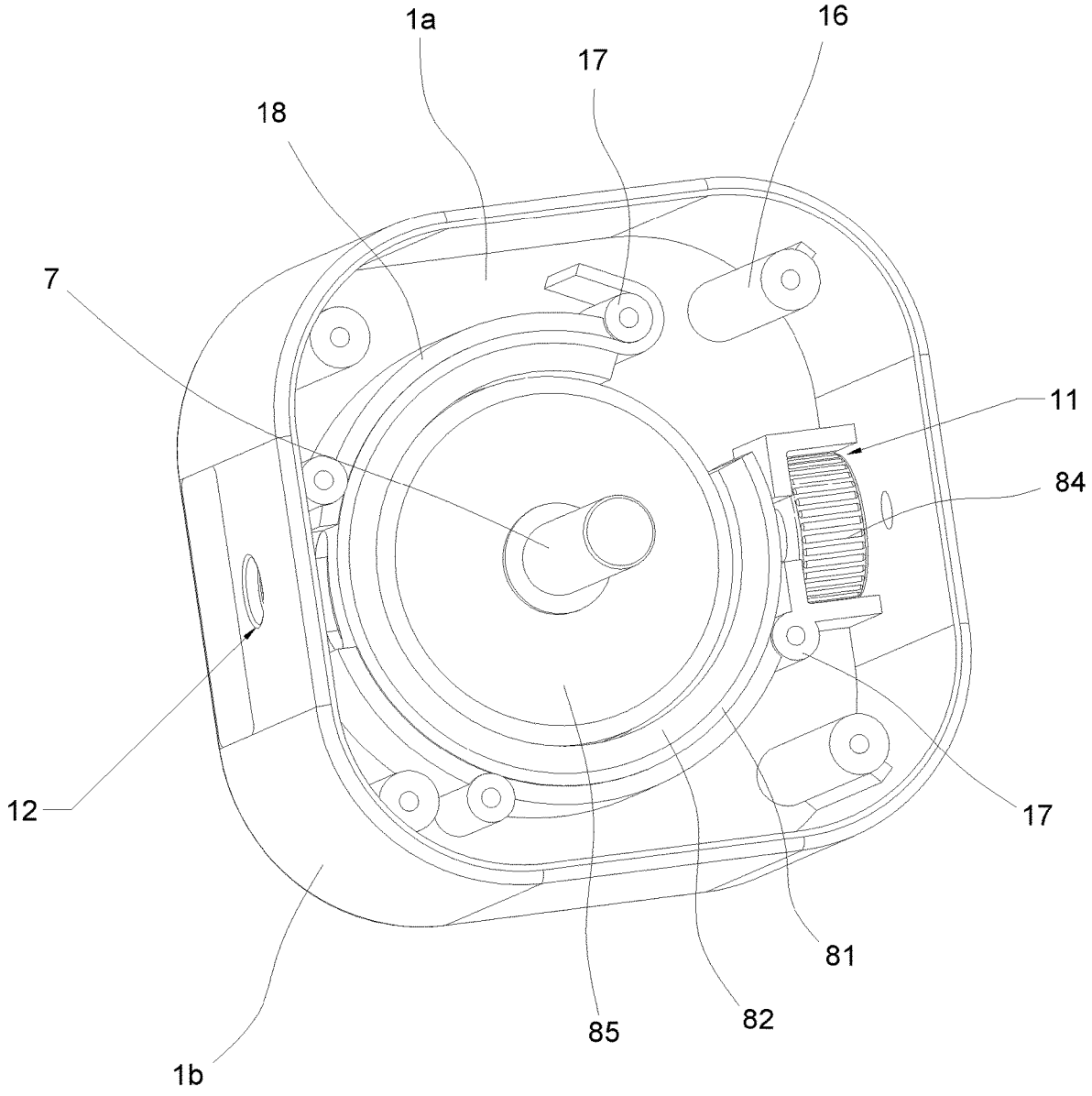
FIG. 5 is an assembly view of a shell and a resistance adjustment mechanism.

As shown in FIG. 1 to FIG. 5, a chest expander comprises a shell 1, a rotating shaft 7, a winding storage wheel 4, an elastic member, a pull strap 5, and a resistance adjustment mechanism 8. The resistance adjustment mechanism 8 comprises a resistance wheel 85, an arc-shaped base strap 81, a friction plate 82, a screw 83, and a nut 84.

The shell 1 comprises a top plate 1*a*, an annular side plate 1*b*, and a bottom plate 1*c*, wherein the top plate 1*a* and the annular side plate 1*b* are integrally injection-molded to form a shell body with an open lower end, and the bottom plate 1*c* closes the lower opening of the shell body. Specifically, a plurality of first connecting columns 16 extending downwards are formed on a bottom surface of the top plate 1*a*, and the bottom plate 1*c* is locked and supported on the first connecting columns 16 by bolts 14.

The elastic member is a spring 3, a spring box 2 with an open upper end is arranged on the bottom plate 1*c*, a mounting groove 13 adapted to a shape of the spring box 2 is formed on a top surface of the bottom plate 1*c*, a plurality of positioning portions 21 protruding outwards are formed on a periphery of the spring box 2, and the positioning portions 21 limits rotation of the spring box 2 relative to the bottom plate 1*c*; an upper end of the rotating shaft 7 is rotatably connected to the top plate 11*a* through an upper bearing 71, and a lower end is rotatably connected to a center of the spring box 2 through a lower bearing 72; the spring box 2 is made of a metal material; the winding storage wheel 4 is arranged on the rotating shaft 7 through a one-way bearing 41, the one-way bearing 41 enables the winding storage wheel 4 to rotate only on one way relative to the rotating shaft 7, a fixing portion 42 located in the spring box 2 is formed in a center of a bottom surface of the winding storage wheel 4, an outer end 31 of the spring 3 is fixed to a positioning portion 21 of the spring box 2, the positioning portion 21 is formed with a first insertion joint 211 matching the outer end 31 of the spring 3, an inner end of the spring 3 is fixed to the fixing portion 42 of the winding storage wheel 4, and the fixing portion 42 is formed with a second insertion joint 421 matching the inner end 32 of the spring 3; the pull strap 5 is connected to the winding storage wheel 4 through a locking bolt 51, a positioning ring through which the locking bolt 51 passes is arranged at an end of the pull strap 5, and the locking bolt 51 is in threaded connection with the winding storage wheel 4 and passes through the positioning ring; and the spring 3 can drive the winding storage wheel 4 to rotate to wind the pull strap 5 on the winding storage wheel 4, the one-way bearing 41 prevents the winding storage wheel 4 from driving the rotating shaft 7 to rotate in this process, and only when the pull strap 5 is pulled out, the winding storage wheel 4 is driven to rotate and the rotating shaft 7 is driven to rotate synchronously.

A metal partition 6 is arranged in the shell 1, a plurality of second connecting columns 17 extending downwards are formed on the bottom surface of the top plate 1*a*, and the metal partition 6 is locked and supported on the second connecting columns 17 by bolts 61; the resistance wheel 85 is fixedly arranged on the rotating shaft 7 above the metal partition 6; and the arc-shaped base strap 81 is a steel strap, one end of the arc-shaped base strap 81 is connected to a second connecting column 17, the screw 83 is arranged on an outer side of the other end of the arc-shaped base strap, one end of the arc-shaped base strap 81 is bent to form a hook capable of hooking the second connecting column 17, the screw 83 is welded and fixed to the outer side of the other end of the arc-shaped base strap 81 and extends radially along the arc-shaped base strap 81, the nut 84 is arranged on the screw 83, the top plate 1*a* is formed with a positioning groove 11 for limiting axial movement of the nut 84, and the positioning groove 11 is opened on an upper surface of the top plate 1*a* to expose the nut 84 partially for operation. This structure can facilitate the operation on the nut 84 and limit the axial movement of the nut 84. An inner surface of the arc-shaped base strap 81 is opposite to a peripheral surface of the resistance wheel 85, the friction plate 82 is arranged on the inner surface of the arc-shaped base strap 81, the friction plate 82 is in frictional contact with the peripheral surface of the resistance wheel 81, the friction plate 82 may be made of rubber or the like, the top plate 1*a* is formed with an arc-shaped side plate 18 close to an outer surface of the arc-shaped base strap 81, and the arc-shaped side plate 18 enables certain pre-tightening force between the friction plate 82 on the inner side of the arc-shaped base strap 81 and the resistance wheel 85. The second connecting columns 17 are arranged in a length direction of the arc-shaped side plate 18, and the top plate 1*a* is spaced apart from the metal partition 6 in parallel. The resistance wheel 85 and the arc-shaped base strap 81 are located between the top plate 1*a* and the metal partition 6, the distance between the top plate 1*a* and the metal partition 6 is slightly greater than the width of the arc-shaped base strap 81, and the metal partition 6 can limit the arc-shaped base strap 81 and prevent the arc-shaped base strap 81 from skewing.

An outlet 12 through which the pull strap 5 passes is formed on the annular side plate 1*b* of the shell 1, two guide rollers 52 opposite and rotatable to the outlet 12 are arranged on the metal partition 6, the two guide rollers 52 are arranged in parallel and opposite, and the pull strap 5 passes between the two guide rollers 52. The two guide rollers 52 can guide a pull direction of the pull strap 5, so that the pull strap 5 is pulled out more smoothly. The two guide rollers 52 are mounted on the metal partition 6 through a mounting rack 53, the mounting rack 53 has an "n"-shaped structure, shaft holes matching roller shafts of the guide rollers 52 are formed on the mounting rack 53 and the metal partition 6 respectively, and the mounting rack 53 is locked to the bottom of the metal partition 6 by bolts. The pull strap 5 needs to overcome the friction between the friction plate 82 and the resistance wheel 85 and the elastic force of the spring 3 when pulled out from the winding storage wheel 4, that is, the resistance of the chest expander is provided by the friction and the elastic force.

When the resistance of the chest expander needs to be increased, the nut 84 is operated to rotate forwards, so that the screw 83 moves towards the resistance wheel 85, and the other end of the arc-shaped base strap 81 is pushed to move towards the resistance wheel 85, which can increase the contact area and pressure between the friction plate 82 and the resistance wheel 85, thereby increasing the friction between the friction plate 82 and the resistance wheel 85 and ultimately increasing the resistance of the chest expander. When the resistance of the chest expander needs to be decreased, the nut 84 is operated to rotate reversely, so that the other end of the arc-shaped base strap 81 moves away from the resistance wheel 85, and the resistance of the chest expander is ultimately decreased. Compared with electromagnetic resistance adjustment in the prior art, the utility model employs purely mechanical adjustment, which achieves a simpler structure and can greatly reduce costs.

A counter 9 is arranged on the annular side plate 1*b* of the shell 1, the counter 9 comprises a magnetic sensor, and a magnet that can be sensed by the magnetic sensor is arranged on the resistance wheel 85. When the pull strap 5 is pulled out and drives the resistance wheel 85 to rotate, the magnetic sensor can detect the magnet, and the counter can generate data such as exercise times according to detection signals of the magnetic sensor and display the data. In order to increase the accuracy of detection on the magnet by the magnetic sensor, a clearance hole 86 that runs through the arc-shaped base strap 81 and the friction plate 82 is further provided. The clearance hole 86 is opposite to the magnetic sensor and the magnet, so that the detection of the magnetic sensor is more accurate. The resistance wheel 85 is provided with a mounting hole 851 for mounting the magnet, and the magnet is mounted in the mounting hole 851.

The metal partition 6 is bent to form a connecting plate 62 attached to the annular side plate 1*b*, a screw hole 621 is formed on the connecting plate 62, and the annular side plate 1*b* is provided with a through hole 19 opposite to the screw hole 621. In this case, a fixing component such as a suction cup can be connected to the screw hole 621 by a bolt, so that the chest expander is fixed to the fixing component such as a suction cup. The connecting plate 62 is arranged on the metal partition 6 to increase the connection strength.

What is claimed is:

1. A chest expander, comprising a shell, a rotating shaft, a winding storage wheel, an elastic member, and a pull strap, wherein the winding storage wheel is rotatably arranged in the shell, the pull strap is connected to the winding storage wheel, the elastic member drives the winding storage wheel to rotate to wind and store the pull strap, the rotating shaft is rotatably arranged in the shell and connected to the winding storage wheel by one-way transmission, and the pull strap can drive the rotating shaft to rotate when pulled out from the winding storage wheel, characterized in that: the chest expander further comprises a resistance adjustment mechanism, and the resistance adjustment mechanism comprises a resistance wheel, an arc-shaped base strap, and a friction plate, wherein the resistance wheel is arranged on the rotating shaft, the arc-shaped base strap is made of an elastic deformable material, the arc-shaped base strap is arranged opposite to a peripheral surface of the resistance wheel, and the friction plate is arranged on an inner surface of the arc-shaped base strap and is in frictional contact with the peripheral surface of the resistance wheel; and one end of the arc-shaped base strap is fixedly connected to the shell, and the other end is movable and adjustable to adjust friction between the friction plate and the resistance wheel.

2. The chest expander according to claim 1, characterized in that: the resistance adjustment mechanism further comprises a screw and a nut, the screw is arranged at the other end of the arc-shaped base strap, and the nut is rotatably arranged on the shell and matches the screw wherein the matching between the screw and the nut can drive the other end of the arc-shaped base strap to move.

3. The chest expander according to claim 2, characterized in that: the shell is provided with a positioning groove for limiting axial movement of the nut, and the positioning groove is opened on a surface of the shell to expose the nut partially outside the shell for operation.

4. The chest expander according to claim 1, characterized in that: the winding storage wheel is arranged on the rotating shaft through a one-way bearing.

5. The chest expander according to claim 1, characterized in that: the arc-shaped base strap is a steel strap.

6. The chest expander according to claim 1, characterized in that: the shell is provided with an arc-shaped side plate attached to an outer surface of the arc-shaped base strap wherein the arc-shaped side plate enables pre-tightening force between the friction plate on the inner side of the arc-shaped base strap and the resistance wheel.

7. The chest expander according to claim 1, characterized in that: the elastic member is a spring, one end of the spring is connected to the winding storage wheel, and the other end is connected to the shell.

8. The chest expander according to claim 1, characterized in that: a counter is arranged on the shell, the counter comprises a magnetic sensor, and a magnet that can be sensed by the magnetic sensor is arranged on the resistance wheel.

9. The chest expander according to claim 8, characterized in that: further comprises a clearance hole that runs through the arc-shaped base strap and the friction plate wherein, the clearance hole is opposite to the magnetic sensor and the magnet.

10. The chest expander according to claim 1, characterized in that: the shell comprises a top plate, a bottom plate, and an annular side plate connected between the top plate and the bottom plate; and a metal partition spaced apart from the top plate in parallel is arranged in the shell, the resistance wheel and the arc-shaped base strap are located between the top plate and the metal partition, the distance between the top plate and the metal partition is greater than the width of the arc-shaped base strap.

11. The chest expander according to claim 10, characterized in that: an outlet through which the pull strap passes is formed on the shell, two guide rollers opposite and rotatable to the outlet are arranged on the metal partition, the two guide rollers are arranged in parallel, and the pull strap passes between the two guide rollers.

12. The chest expander according to claim 10, characterized in that: the metal partition is formed with a connecting plate attached to the annular side plate, a screw hole is formed on the connecting plate, and the annular side plate is provided with a through hole opposite to the screw hole.

* * * * *